US006520711B2

(12) United States Patent
Kim

(10) Patent No.: US 6,520,711 B2
(45) Date of Patent: Feb. 18, 2003

(54) SHOCK ABSORPTION STAND FOR A ROAD

(75) Inventor: Chang-Wook Kim, Busan (KR)

(73) Assignee: Geo Do Industry Co., Ltd., Busan (KR)

( * ) Notice: Subject to any disclaimer, the term of this patent is extended or adjusted under 35 U.S.C. 154(b) by 0 days.

(21) Appl. No.: 09/828,908

(22) Filed: Apr. 10, 2001

(65) Prior Publication Data

US 2002/0146283 A1 Oct. 10, 2002

(51) Int. Cl.[7] ..... E01F 15/00
(52) U.S. Cl. ..... 404/6; 404/10; 256/13.1
(58) Field of Search ..... 404/6, 7, 9, 10; 256/1, 13.1

(56) References Cited

U.S. PATENT DOCUMENTS

| | | | | | |
|---|---|---|---|---|---|
| 1,795,247 | A | * | 3/1931 | Burns | 256/13.1 |
| 3,145,685 | A | * | 8/1964 | Kulick, Sr. | 114/220 |
| 3,254,491 | A | * | 6/1966 | Levinton | 205/213 |
| 3,416,484 | A | * | 12/1968 | Chapman | 256/13.1 |
| 3,464,214 | A | * | 9/1969 | King | 405/214 |
| 3,602,109 | A | * | 8/1971 | Harrington | 256/13.1 |
| 4,183,505 | A | * | 1/1980 | Maestri | 256/13.1 |
| 4,662,611 | A | * | 5/1987 | Ruane | 256/13.1 |
| 4,824,282 | A | * | 4/1989 | Waldecker | 404/6 |
| 4,877,224 | A | * | 10/1989 | Watts | 267/140 |
| 5,549,279 | A | * | 8/1996 | Aszkenas | 256/13.1 |
| 5,597,262 | A | * | 1/1997 | Beavers et al. | 404/6 |
| 5,678,365 | A | * | 10/1997 | Venegas, Jr. | 404/6 |
| 6,010,275 | A | * | 1/2000 | Fitch | 404/6 |
| 6,059,487 | A | * | 5/2000 | Haga et al. | 404/6 |
| 6,102,611 | A | * | 8/2000 | Roller | 404/6 |

FOREIGN PATENT DOCUMENTS

| | | | | |
|---|---|---|---|---|
| JP | 05279622 A | * | 7/1993 | E01F/15/00 |
| WO | WO 92/00420 | * | 1/1992 | E01F/15/00 |

* cited by examiner

*Primary Examiner*—Robert E. Pezzuto
*Assistant Examiner*—Alexandra K. Pechhold
(74) *Attorney, Agent, or Firm*—Jacobson Holman PLLC

(57) ABSTRACT

A shock absorption stand for a road, which is capable of minimizing shock at the time of collision and making a car progress forward by having a roller and by being installed in a roadside, a central line, a pier, a guardrail of bridge or a wall surface of underground roadway. The shock absorption stand for a road includes upper and lower plates, shaft rods mounted between the upper and lower plates in regular intervals, and a plurality of roller rotatably mounted on the shaft rods. The rollers are made of a material capable of absorbing shock, such as rubber, synthetic resin or steel pipes. When the car collides, the shock absorption stand buffs shock and makes the car advance forward in the progressive direction.

13 Claims, 7 Drawing Sheets

SHOCK ABSORPTION STAND FOR A ROAD

BACKGROUND OF THE INVENTION

1. Field of the Invention

The present invention relates to a shock absorption stand for a road, and more particularly, to a shock absorption stand for a road, which is capable of minimizing shock at the time of collision and making a car progress forward by having a roller and by being installed in a roadside, a central line, a pier, a guardrail of bridge or a wall surface of underground roadway.

2. Description of the Related Art

In general, to reduce terrible traffic accidents caused by overspeed or troubles of a car traveling on a road, a guardrail or a median strip are installed on the roadside or the central line of the road. The conventional guardrail is constructed in such a manner that an iron plate having a convexoconcave part of longitudinal direction is driven and fixed into the ground with a stay pole. However, such guardrail can stand a slight shock to a certain extent, but if the car rushing in a rapid speed collides against the guardrail, cannot absorb the shock and results in terrible accidents, such as serious damage of the car and the toll of lives, by being damaged, overturned and fell off the guardrail.

Moreover, the conventional median strip, which is installed on the central line where the car may easily invade the central line in the curved corner or an entrance and an exit of the underground roadway, is constructed in such a manner that bars coated with fluorescent paints are stood on the ground in regular intervals. When colliding against the median strip by a driver's carelessness, the car lets fall and pushes the median strip and invades the central line, and thereby the car comes into a head-on collision with another car, which comes running oppositely. Furthermore, the cars often collide against the curved wall surface of the underground railway. However, such median strip only serves to induce the cars not to invade the central line, but cannot prevent damages of cars and the toll of lives when the cars collide against the median strip or the wall surface because not having a shock absorber.

SUMMARY OF THE INVENTION

It is, therefore, an object of the present invention to provide a shock absorption stand for a road, which is constructed in such a manner that a plurality of shaft rods are installed between an upper plate and a lower plate in regular intervals and a plurality of rollers of a material capable of absorbing shock, such as rubber, synthetic resin or steel pipes, are rotatably inserted onto the shaft rods, thereby buffing shock by the rotation of the rollers at the time of a collision of a car and inducing the car in a progressive direction to make the car go into orbit.

To achieve the above object, the present invention provides a shock absorption stand for a road including shaft rods mounted between an upper plate and a lower plate in regular intervals by upper and lower ends thereof fastened with nuts and buffer rollers made of synthetic resin material, such as rubber, urethane, steel pipes, mixed powder of waste tires, or polyethylene, rotatably inserted onto the shaft rods with spacers in regular intervals. The shock absorption stand may be used in various purposes. That is, stay poles are fixed to sides of the shock absorption stand with U-shaped bolts for using as a guard rail, the stay poles are continuously connected to the shock absorption stand for using as a median strip capable of buffing both sides of the road at the same time, or the shock absorption stand is formed in a round shape and installed on a pier of bridge or a wall surface of underground roadway for buffing shock.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
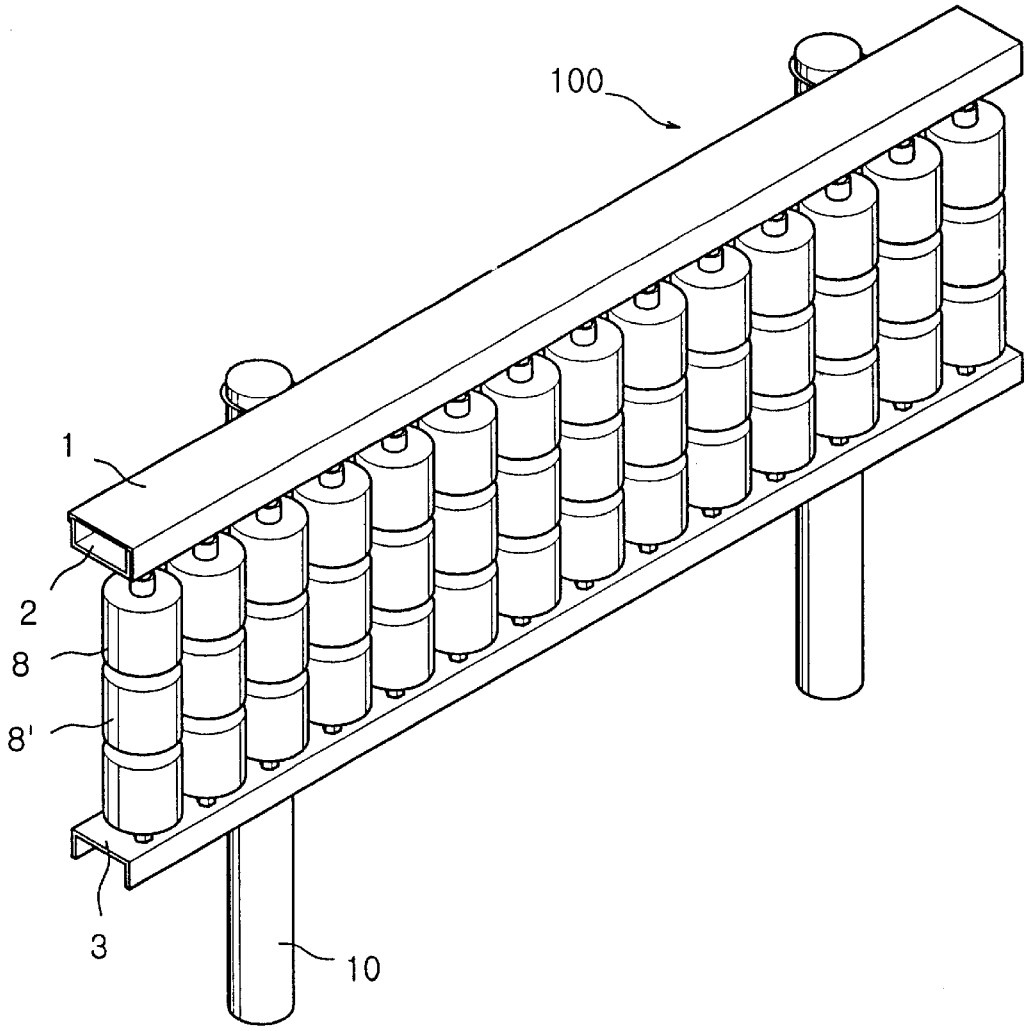
FIG. 1 is an exemplary view of a state that the present invention is used as a guardrail.

The present invention will now be described in detail in connection with preferred embodiments with reference to the accompanying drawings. For reference, like reference characters designate corresponding parts throughout several views.

As shown in FIG. 1, a shock absorption stand for a road according to the present invention includes an upper plate 2 and a lower plate 3 of a form of "[", which are covered with a cover 1 and symmetrically disposed, shaft rods 4 mounted between the upper and lower plates 2 and 3 in regular intervals and fastened with nuts 6 in such a manner that spiral parts 4' of both ends are projected through holes 5 of the upper and lower plates 2 and 3 respectively, and buffer rollers 8 and 8' made of synthetic resin material, such as rubber, urethane, steel pipes, waste tire compact or polyethylene, having a shaft rod hole 7 respectively and rotatably inserted onto the shaft rod 4 in regular intervals with spacers 9.

Because the buffer rollers 8 and 8' are rotatably mounted oil the shaft rod 4, which is mounted between the upper and lower plates 2 and 3, in multi-stages by the spacers 9, the buffer rollers can freely rotate on the shaft rod 4. Thus, if a car collides slantingly in a progressive direction during traveling, shock is buffed by the buffer rollers 8 and 8' rotating on the shaft rod 4 and the car advances forward in the progressive direction by the rotation of the buffer rollers 8 and 8', and thereby the car can go into orbit to prevent an overturn or a fall of the car.

Here, it is preferable that the buffer rollers 8 and 8' are made of synthetic resin, such as rubber, urethane, waste tire compact or polyethylene, but may be made of steel pipes or cement if the buffer rollers can rotate by the shaft rod 4.

Figure 2:
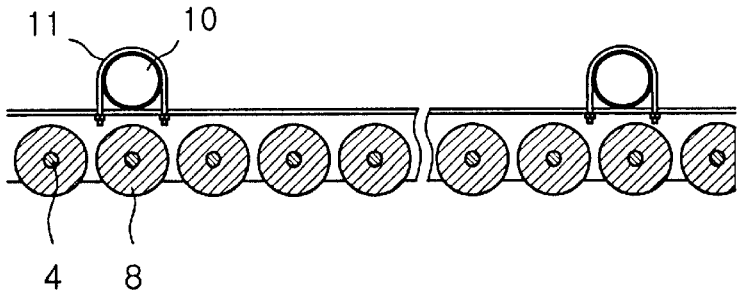
FIG. 2 is a partially horizontally sectional view of FIG. 1.
Figure 3:
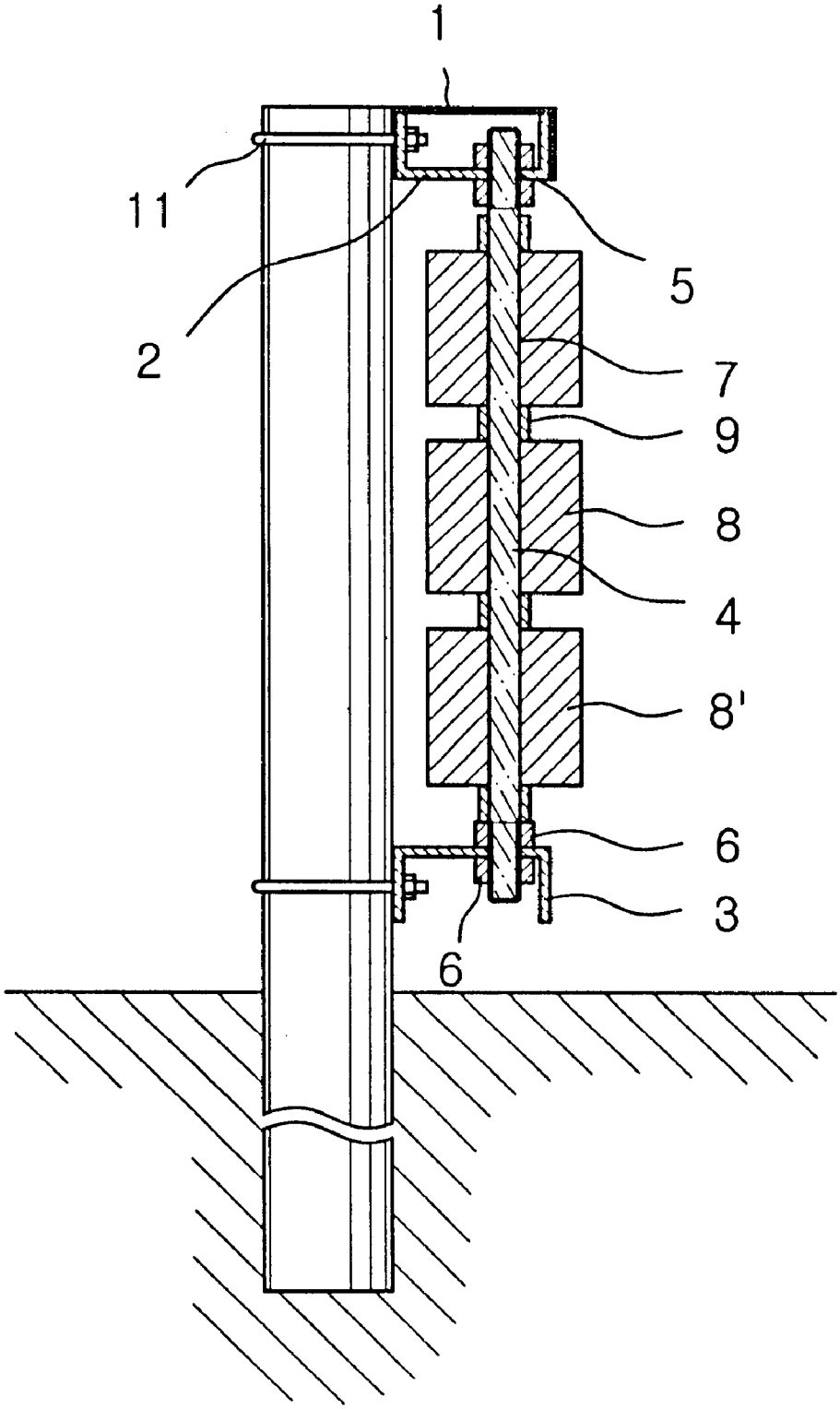
FIG. 3 is a longitudinally sectional view of an installation state of FIG. 1.
Figure 4:
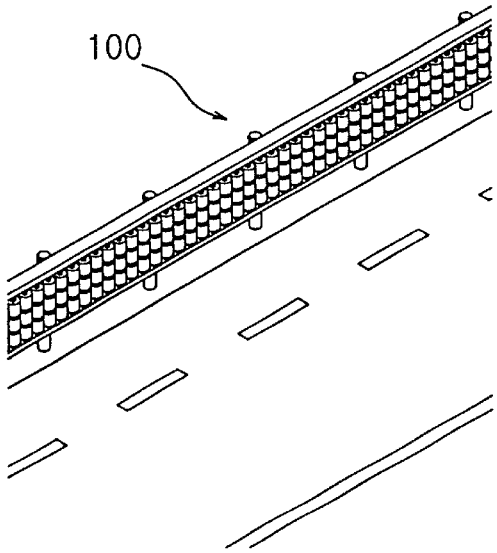
FIG. 4 is an exemplary view of FIG. 1.
Figure 5:
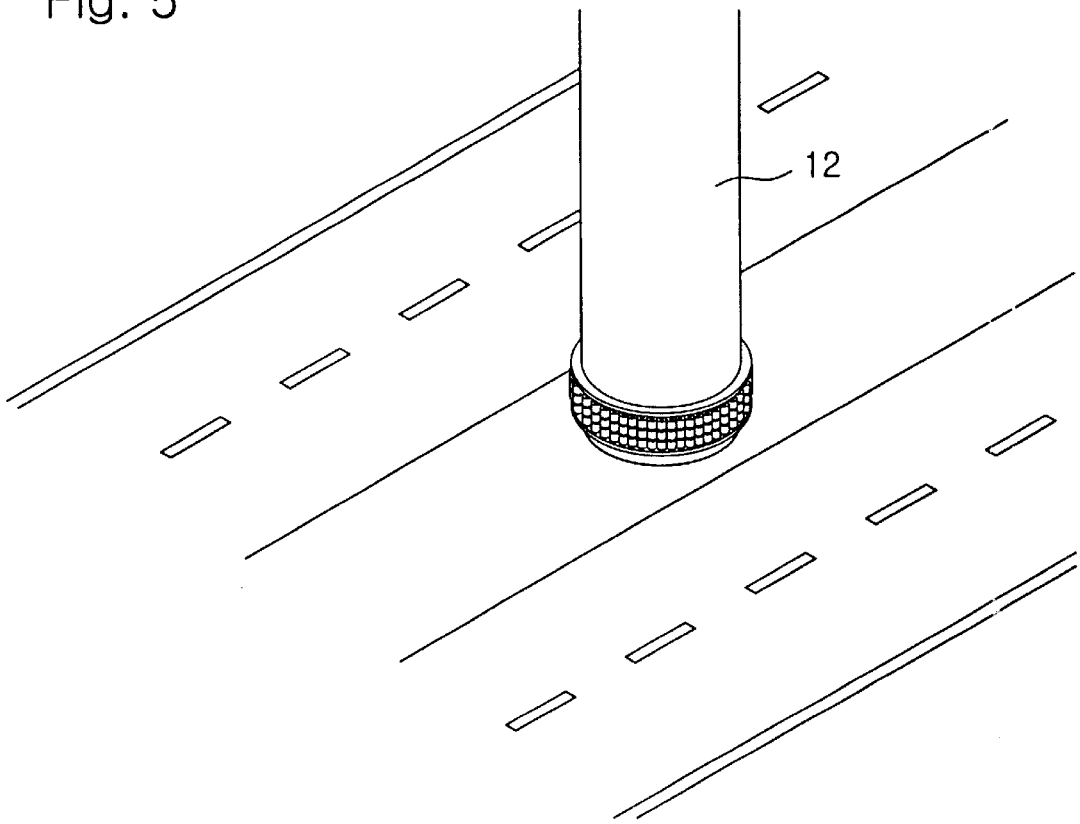
FIG. 5 is an exemplary view of a state that the present invention is installed on piers of bridge.
Figure 6:
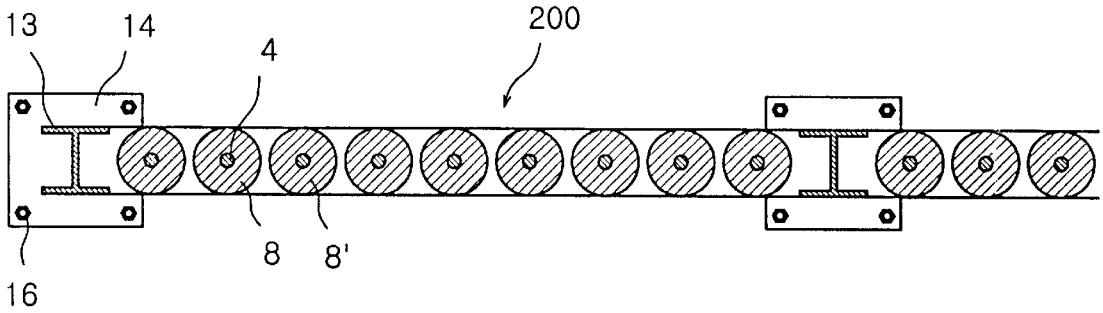
FIG. 6 is an exemplary view of a state that the present invention is used as a median strip.
Figure 7:
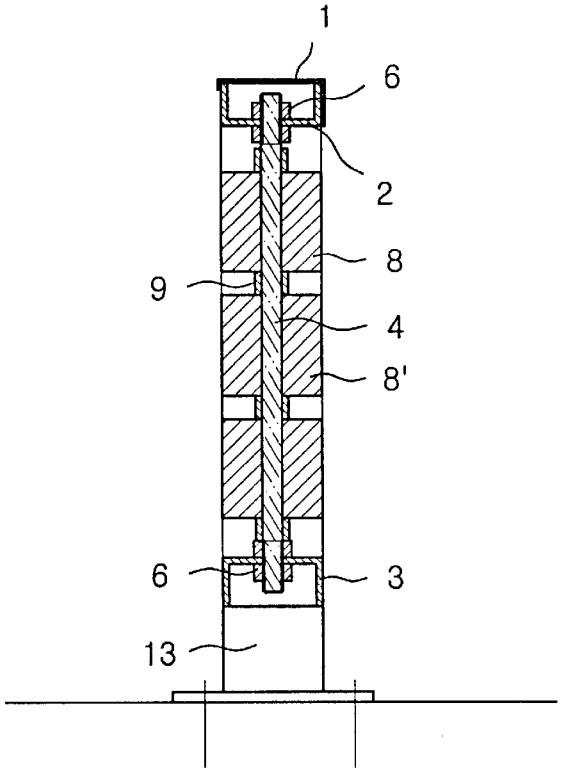
FIG. 7 is a longitudinally sectional view of an installation state of FIG. 6.
Figure 8:
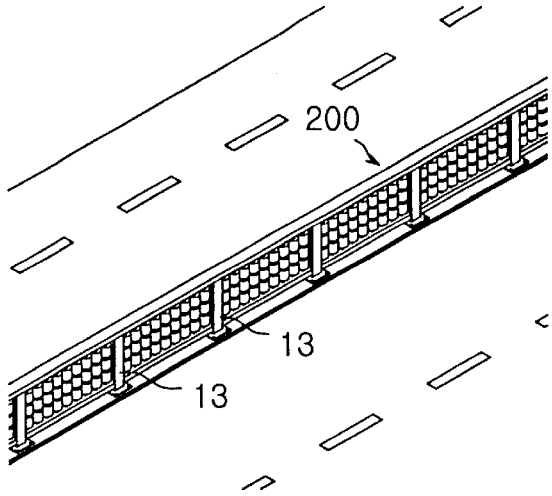
FIG. 8 is an exemplary view of a used state of FIG. 6.

As shown in FIGS. 1 through 3, stay poles 10 are fixed at sides of the upper and lower plates 2 and 3 with U-shaped bolts 11 and installed at the roadside as a guardrail 100. Alternatively, as shown in FIG. 5, the shock absorption stand is formed in a round and attached to a pier 12 of bridge for the purpose of absorbing shock at the time of a collision. Otherwise, as shown in FIGS. 6 through 8, stay rods 13 such as an H beam are fixed at both ends of the upper and lower plates 2 and 3 of the shock absorption stand. The stay rods 13 fixed at both ends of the upper and lower plates 2 and 3 are connected continuously to a degree of required length and abutments 14, each of which is mounted at a lower end of the stay rod 13, are fastened on a concrete ground with anchor bolts 16 respectively, and thereby it can be used for a median strip 200 capable of absorbing shock at both sides of the road.

Figure 9:
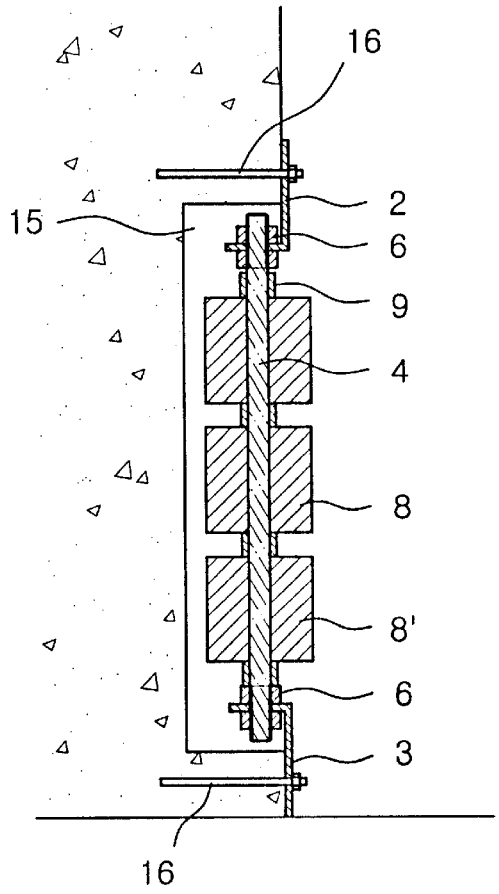
FIG. 9 is an exemplary view of a state that the present invention is installed in a concave part of a wall surface.
Figure 10:
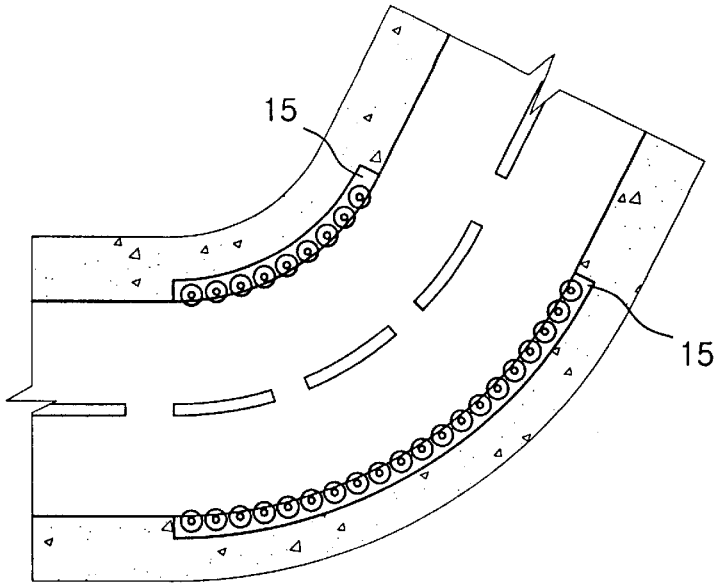
FIG. 10 is an exemplary view of a used state of FIG. 9.
Figure 11:
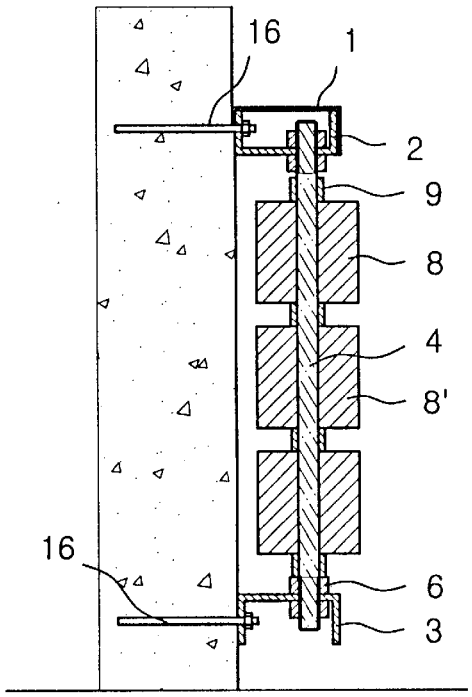
FIG. 11 is a sectional view of the present invention installed on the wall surface.

As shown in FIGS. 9 and 10, a concave part 15 is formed in a curved portion of the road or a wall surface of an entrance and an exit of the underground roadway being in the form of a S-shape, and the shock absorption stand of the present invention is fastened in the concave part 15 with the anchor bolts 16. Alternatively, as shown in FIG. 11, if the shock absorption stand of the present invention is projectingly attached and fastened on the wall surface without forming the concave part 15, shock can be buffed and damage of the car can be reduced when the car collides against the wall surface at the entrance of the underground roadway. However, as described above, it is very effective to form the concave part 15 in the case of a narrow road.

Figure 12:
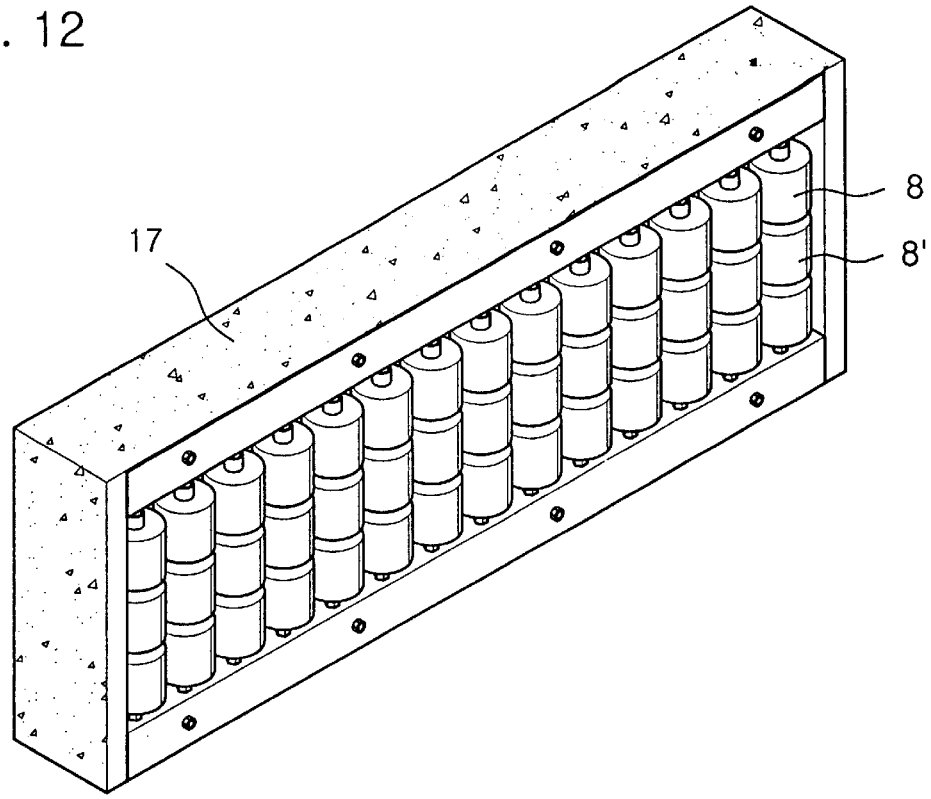
FIG. 12 is a perspective view of the present invention installed on a concrete structure.
Figure 13:
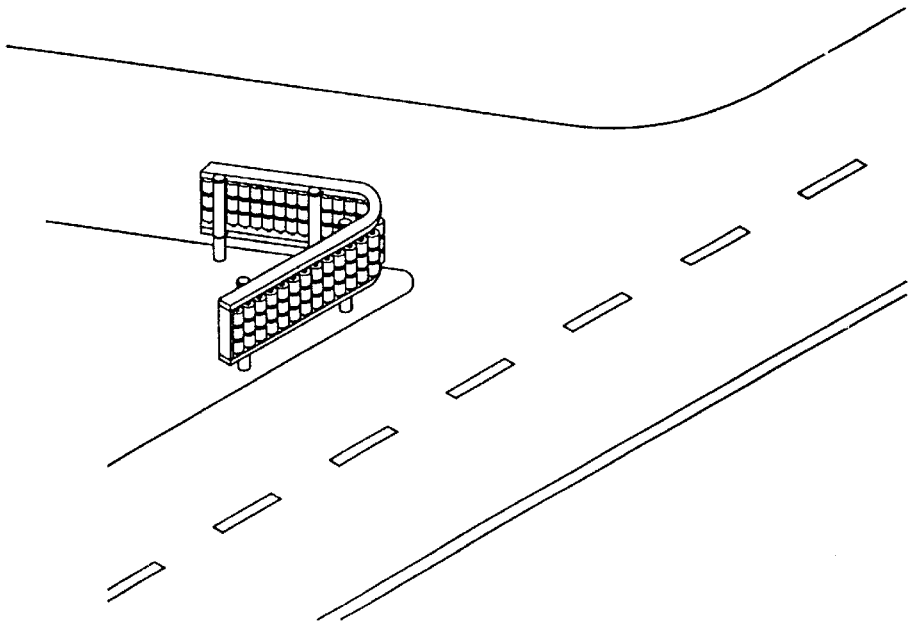
FIG. 13 is an exemplary view of the present invention installed on a trigonal area.

In another embodiment, as shown in FIG. 12, when a concrete structure 17 is constructed, if the shock absorption stand is installed and fixed integrally with the concrete structure 17, the structure embedding the shock absorption stand can be easily installed in areas without any wall surface or installing material. As shown in FIG. 13, the shock absorption stand of the present invention is installed in a trigonal area of the road in the form of a '⅄' shape to reduce accidents due to the collision. Furthermore, the shock absorption stand of the present invention is installed on the guardrail of bridge to make the car advance forward in the progressive direction by the buffer rollers 8 and 8' at the time of the collision, thereby preventing the toll of lives by preventing the car from falling to the pier 12 or a riverside.

The buffer rollers 8 and 8' installed in the multi-stages is installed to have a height from the ground for protecting the car and the driver according to the geographical features of the road in consideration of the collision of the car.

As described above, because the shock absorption stand according to the present invention is constructed in such a manner that the plural buffer rollers 8 and 8' are rotatably installed in the multi-stages, it can be used as the guardrail 100 of the roadside and used for shock buffing of the median strip 200, the pier 12 of bridge and the wall surface. Especially, when the car collides, the shock absorption stand buffs shock and makes the car advance forward in the progressive direction, thereby preventing traffic accidents, such as the overturn and the fall of the car.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A shock absorption stand for a road, comprising:

an upper plate and a lower plate, said plates being symmetrically disposed and having aligned holes;

at least one upper cover for covering said upper plate;

a plurality of shaft rods having spiral ends, each said shaft mounted between said upper and lower plates in regular intervals with said spiral ends projecting through said aligned holes of said upper and lower plates respectively;

a plurality of buffer rollers, each said buffer roller having a shaft rod hole respectively, said buffer rollers being freely rotatably inserted onto at least one of said plurality of shaft rods between said upper and lower plates;

at least one spacer having a spacer hole for inserting onto at least one of said plurality of shafts at regular intervals between said buffer rollers;

a plurality of nuts for securing said spiral ends of each said plurality of shafts;

said shock absorption stand is installed and fixed in an inside of a concrete structure; and anchor bolts buried in the concrete structure and fixed to sides of said upper and lower plates for installing as a guardrail.

2. The shock absorption stand as claimed in claim 1, further comprising:

stay poles buried in the ground and fixed to sides of said upper and lower plates;

U-shaped bolts for fixing said stay poles to said sides of said upper and lower plates for installing as a guardrail;

stay rods with lower ends fixed at both said ends of said upper and lower plates and connected continuously to a degree of required length; and abutments mounted at said lower end of the stay rods and fastened on said concrete structure with anchor bolts respectively, for using as a median strip capable of absorbing shock at both sides of the road.

3. The shock absorption stand as claimed in claim 2, further comprising a concave part formed in a curved portion of the road or a wall surface of an entrance and an exit of an underground roadway being in the form of a S-shape, and the shock absorption stand is fastened in the concave part.

4. The shock absorption stand as claimed in claim 2, wherein said buffer rollers are made of rubber.

5. The shock absorption stand as claimed in claim 2, wherein said buffer rollers are made of urethane.

6. The shock absorption stand as claimed in claim 2, wherein said buffer roller are made of synthetic resin.

7. The shock absorption stand as claimed in claim 1, further comprising:

at least one lower cover for covering said lower plate; and said shock absorption stand is formed as a round shape for installing on a pier of a bridge.

8. The shock absorption stand as claimed in claim 7, wherein said buffer rollers are made of rubber.

9. The shock absorption stand as claimed in claim 7, wherein said buffer rollers are made of urethane.

10. The shock absorption stand as claimed in claim 7, wherein said buffer roller are made of synthetic resin.

11. The shock absorption stand as claimed in claim 1, wherein said buffer rollers are made of rubber.

12. The shock absorption stand as claimed in claim 1, wherein said buffer rollers are made of urethane.

13. The shock absorption stand as claimed in claim 1, wherein said buffer roller are made of synthetic resin.

* * * * *